US007718984B2

(12) United States Patent
Edwards et al.

(10) Patent No.: US 7,718,984 B2
(45) **Date of Patent: *May 18, 2010**

(54) OPTIMIZED NUCLEAR RADIATION SHIELDING WITHIN COMPOSITE STRUCTURES FOR COMBINED MAN MADE AND NATURAL RADIATION ENVIRONMENTS

(75) Inventors: Carl S. Edwards, San Diego, CA (US); Michael Featherby, San Diego, CA (US); David J. Strobel, Poway, CA (US)

(73) Assignee: Space Micro Inc., San Diego, CA (US)

( * ) Notice: Subject to any disclaimer, the term of this patent is extended or adjusted under 35 U.S.C. 154(b) by 426 days.

This patent is subject to a terminal disclaimer.

(21) Appl. No.: 11/431,474

(22) Filed: May 10, 2006

(65) Prior Publication Data

US 2006/0255299 A1 Nov. 16, 2006

Related U.S. Application Data

(60) Provisional application No. 60/679,537, filed on May 10, 2005.

(51) Int. Cl.
*G21F 3/00* (2006.01)
*G21F 1/00* (2006.01)
*G21F 7/00* (2006.01)

(52) U.S. Cl. ..... 250/515.1; 250/516.1; 250/519.1; 252/478

(58) Field of Classification Search ..... 250/515.1, 250/505.1, 516.1, 517.1, 518.1, 519.1; 252/478
See application file for complete search history.

(56) References Cited

U.S. PATENT DOCUMENTS

| | | | | |
|---|---|---|---|---|
| 3,979,357 | A * | 9/1976 | Salyer et al. | 524/80 |
| 4,123,392 | A * | 10/1978 | Hall et al. | 252/478 |
| 4,923,741 | A * | 5/1990 | Kosmo et al. | 442/187 |
| 5,360,858 | A * | 11/1994 | Fujiki et al. | 524/434 |
| 5,416,333 | A * | 5/1995 | Greenspan | 250/515.1 |
| 5,635,754 | A * | 6/1997 | Strobel et al. | 257/659 |
| 6,172,163 | B1 * | 1/2001 | Rein et al. | 525/240 |
| 6,261,508 | B1 * | 7/2001 | Featherby et al. | 264/408 |
| 6,518,754 | B1 * | 2/2003 | Edwards | 324/303 |
| 6,583,432 | B2 * | 6/2003 | Featherby et al. | 250/515.1 |
| 2003/0025089 | A1 * | 2/2003 | Featherby et al. | 250/515.1 |
| 2006/0202168 | A1 * | 9/2006 | Barrera et al. | 252/500 |
| 2006/0255299 | A1 * | 11/2006 | Edwards et al. | 250/515.1 |
| 2007/0194256 | A1 * | 8/2007 | Srobel et al. | 250/515.1 |
| 2008/0128659 | A1 * | 6/2008 | Parker et al. | 252/478 |

* cited by examiner

*Primary Examiner*—Bernard E Souw
(74) *Attorney, Agent, or Firm*—Continuum Law; Robert P. Cogan

(57) ABSTRACT

A composition for radiation shielding or range of compositions which compositions may be used for a variety of radiation shielding applications. With proper adhesive selection and processing, the construction forms an integral bond with the craft as compatible adhesives form strong bonds. This eliminates the potential for delaminating associated with the use of metallic layered shielding. While prior art protects electronics with a direct coating to electronic packages, this approach allows larger equipment systems, such as optics, or spectrometers, to be shielded.

9 Claims, 3 Drawing Sheets

Graph 1: 20 mil Gadolinium with 80 Tungsten composite behind it.
Conditions: Dose 0.1 Cal/cm2, 30 ns rise time, 3 keV BB X Ray FIG. 3
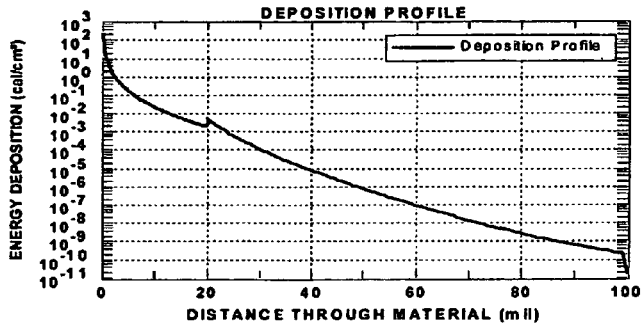
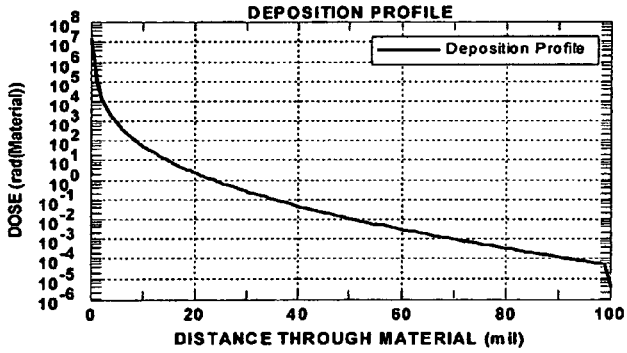
Graph 2: Deposition profile 100 mil W composite (13.2 g/cc)
Conditions: Dose 0.1 Cal/cm2, 30 ns rise time, 3 keV BB X Ray
FIG. 4

OPTIMIZED NUCLEAR RADIATION SHIELDING WITHIN COMPOSITE STRUCTURES FOR COMBINED MAN MADE AND NATURAL RADIATION ENVIRONMENTS

CROSS REFERENCE TO RELATED APPLICATIONS

This application claims the benefit of Provisional U.S. Patent Application 60/679,537 filed May 10, 2005, the contents of which are hereby incorporated by reference in their entirety.

FIELD OF THE INVENTION

The present inventive subject matter relates to an optimized radiation shielding material, to be employed within a composite structure in space related or high altitude (exoatmospheric) applications.

BACKGROUND OF THE INVENTION

Many fields benefit from radiation shielding, including space related or high-altitude applications. Earlier materials, such as RAD-COAT™ or RAD-PAK™, either placed a coating directly on the semiconductor die or package or utilized shields made of a gold plated Tungsten-Copper alloy. Foil shielding, however, when incorporated into the walls of space vehicles, are prone to mechanical failure during use, as the adhesive bond between the metal and the organic adhesive of the composite is susceptible to thermal expansion mismatch between the metal and the adhesive. Further the bonds between dissimilar materials are not as robust as bonds between like materials. In the invention, having the matrix material in the shield either match or be chemically compatible with the composite construction of the spacecraft mitigates this. The matrix adhesive in the shield can bond chemically with the adhesive in the walls of the spacecraft, forming a truly mechanically integrated structure.

SUMMARY OF THE INVENTION

There is therefore a need for a radiation shield that can be an integral part of the space craft construction, that will not compromise the mechanical performance of the spacecraft; which is compatible with the assembly processes associated with said construction; which is easy to fabricate and which can address the radiation shielding needs of the application.

In the invention the resin in the Tungsten composite acts as an integral low Z material so that no separate absorber is required. Other fillers can be substituted for Tungsten for different environments, such as Gadolinium or Boron for neutron shielding. Further, thickness variations can be made to optimize the spatial shielding efficiency (and weight). Powder mixtures and powder gradients are possible which provide the best overall reduction of the various forms of radiation. The lack of sharp interfaces eliminates the thermal spikes that can occur at these locations.

The invention physically consists of, a filler to block the radiation, an organic resin, such as epoxy or cyanate ester. Additionally, the formulation may employ additives such as fumed silica and various solvents to facilitate rheological modifications during processing. The filler or fillers are selected based on the radiation shielding performance and environment for such species as X-ray, neutron, gamma and cosmic rays. Fillers may include such materials as Boron, Tungsten, Titanium, Tantalum, Gadolinium and Hafnium or some combination of these. Radiation performance is optimized by reaching optimum material density, as material density is proportional to radiation attenuation performance.

The invention can use a broader array of fillers than the foil approach. While Tungsten is the preferred shielding material for many radiation environments, Tungsten in sheet and foil is very difficult to work with because of its brittleness. Joining is equally difficult because if its refractoriness, poor solder ability and oxidation resistance. The invention addresses this problem by using powder fillers. The powder, combined with a resin matrix is easier to shape and process but still yields high enough density to provide effective radiation shielding.

The invention also permits the incorporation of various sensor devices within its structure to enable real time monitoring of the spacecraft health for such parameters as temperature, radiation, and pressure. This refers to the ability of the invention to perform as a "smart composite".

BRIEF DESCRIPTION OF THE FIGURES

FIG. 3 is a graph of energy deposition vs. material depth to illustrate radiation attenuation provided by a second embodiment; and FIG. 4 is a graph of radiation dose vs. material depth to illustrate radiation attenuation provided by a second embodiment.

DETAILED DESCRIPTION OF THE INVENTION

Figure 1:
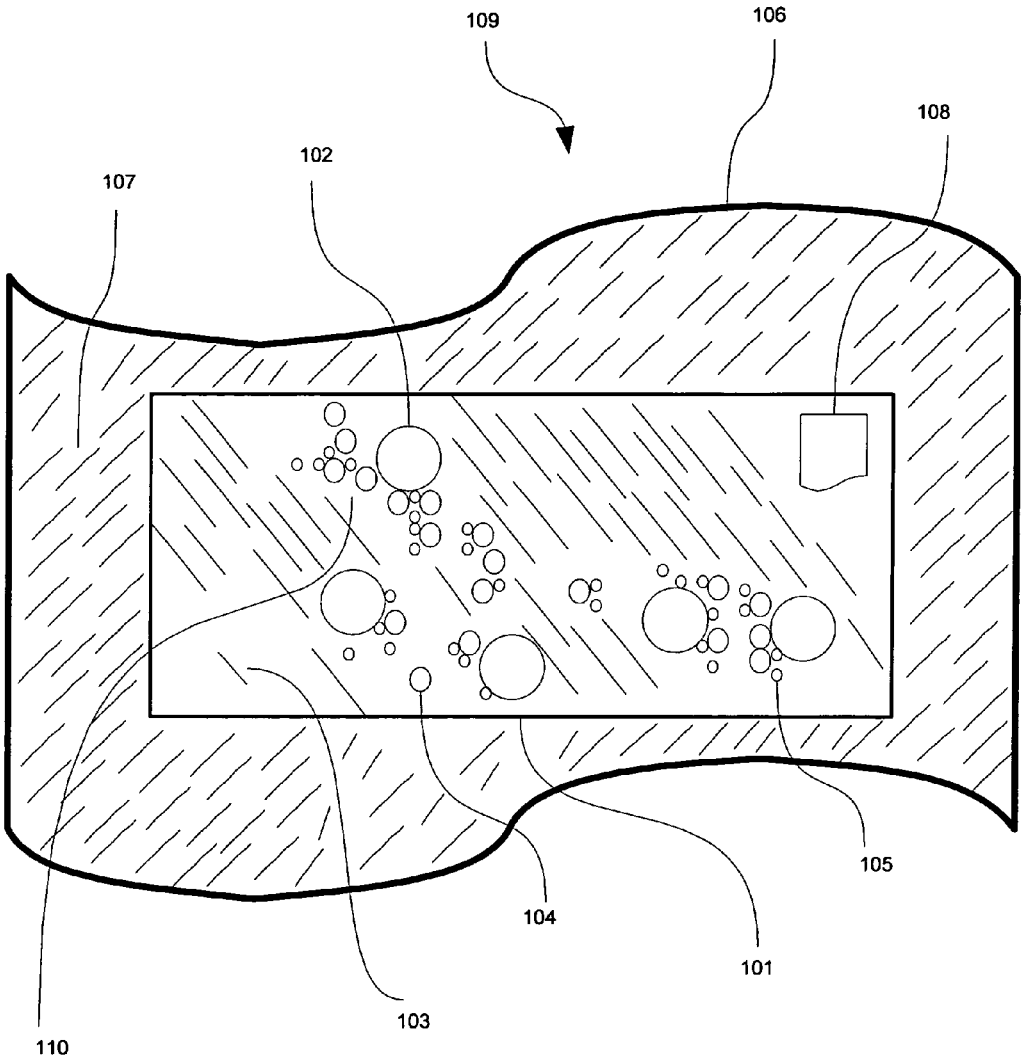
FIG. 1 is a perspective view of an embodiment of the present inventive subject matter prior to assembly within another construction.

The present inventive subject matter is directed to a composition for building a radiation shield that can be integrated within the composite structure of a spacecraft. FIG. 1 depicts a non-limiting example of an embodiment of the present inventive subjective matter. In FIG. 1 in which the inventive compositions are used in radiation shielding, a shield formed of a composite material can be physically laminated within a spacecraft wall structure, either embedded within the structure or placed on the surface or the structure. As can be seen in FIG. 1, the patent consists of a composite material. The outer surface (101) of the material can be adhered within the structure and integral to the structure of a spacecraft (107) via the use of compatible adhesives. In the case of the invention, the matrix material is an adhesive such as epoxy, bismalemide, or cyanate ester. The invention incorporates a filler material made up of various particle size distributions (102) and (104), which pack together to form an extremely dense composite material within the adhesive matrix (103). Incorporated within the organic matrix (103) there may be a fugitive solvent (110), that does not remain in the final product, but serves to densify the product during the cure process. Further, rheological additives (105), such as fumed silica, may be added to adjust rheology while the material is in the liquid state. Finally, the shield is designed to protect from radiation (109), either natural or man made, occurring on the outside of the spacecraft and entering through the hull (106).

The invention enables the incorporation of embedded sensors (108), such as MEMS (Micro Electronic Mechanical System) or fiber optic sensors, for the purpose of monitoring the spacecraft health during operation. This allows for real time measurement of pressure, temperature, stress, radiation and other environmental conditions that can affect the performance of the spacecraft.

There are mechanical and structural advantages as well. Dispersing the powders in a polymer eliminates the potential for residual thermal stresses between material layers with dissimilar coefficients of thermal expansion. These stresses can unbalance the structure or cause delamination of foil technologies.

Manufacturing Improvements

This technology provides for application and manufacturing flexibility. Coatings on curved and complex surfaces can be achieved, either by fabricating a flexible tile or stenciling the material into a location within the composite structure. The composite shield resin can be B-staged for easy attachment to the structural base. B-staged is the intermediate stage during the curing process when material has gelled but is not fully cured. With proper processing and adhesive selection, the shield can become an integrated part of the entire structure. Thus, co-curing is possible. An example of a formulation can be seen in the Table 1 and process menu below.

TABLE 1

Compositional Example of Black body X-ray, neutron shield

| Component | Percentage by weight |
|---|---|
| Tungsten | 70-100 |
| Gadolinium | 0-30 |
| Organic Resin | 0-5 |
| Rheological filler | 0-5 |

1. Weigh out the components, using a weigh scale.

2. Mix ingredients: Using a suitable mixing vessel, place the weighed ingredients in the vessel and mix thoroughly, either by hand or machine, at room temperature. The mixing step is finished when all ingredients are wetted out and the batch is not lumpy.

3. Place the mix into a net shape mold: A spatula is used to place the material into the mold 4. Level the mix in the mold, using a vibrator table.

5. Place the mold with the mix into a vacuum bag, per traditional composites processing. This will require a vacuum that will let out air and outgassing solvent.

6. Put the whole sample into an oven at a present temperature.

7. Cure the coating: For example, set oven at 90 to 150 C.+−10 C. Set the coated samples in the oven and cure for 4 to 8 hours, depending on whether traditional full cure or b stage cure is desired.

8. Remove the item from the oven and inspect for thickness uniformity.

9. Allow the sample to cool and remove carefully from the mold. Vacuum bag the sample to protect the sample from a dirty or wet environment.

These and other aspects and features of the invention will be better understood by those of skill in the art with reference to the following figure and description wherein like numbers represent like objects throughout the several views.

In terms of application, the invention employs the use of particle packing to optimize the composite density. Approximately 68% to 75% of theoretical density for Tungsten can be achieved by selecting the appropriate filler particle size distributions (PSD), which can be found in the literature by someone reasonably skilled in the technology. For both configuration 1 and configuration 2 in Table, there is almost complete radiation attenuation.

In terms of application, the invention offers advantages over current technologies.

Complex shapes are difficult to conform to mechanically dissimilar surfaces with brittle and stiff foils. The invention is designed to be process flexible, as it can be applied as a paste, a stencil or B-stage to allow placement in non-planar structures and be co-processed with the overall assembly.

B-stage processing refers to the practice of partially reacting the organic system to achieve 30% to 50% cure. This forms a rigid structure that can be made soft by warming to a temperature in the range of 70° to 150° C. for a short period of time. This allows the shield to be formed into non-planar, i.e. cylindrical forms, further reducing mechanical stress between the composite components. The processing is compatible with composites technology as it uses adhesives that are chemically and mechanically compatible with the composite. Since it bonds with the composite, it forms an integral part of the structure to yield excellent adhesion at the attachment surfaces.

In terms of application, the invention lends itself to the fabrication of smart composites, through the insertion of sensors, such as MEMS devices, into the overall construction. A smart composite is defined as a "Composite containing built-in computers and/or sensors which enable space systems to detect changes such as pressure, strain, temperature, radiation level, internal defects and damage."

Simulated Environments and Analysis

The inventors have provided predictive modeling of the candidates for radiation attenuation, using the Testable Hardware Toolkit (THTk), provided by the Defense Threat Reduction Agency (DTRA).

Two examples of material configurations for radiation shielding can be seen in Table 2.

TABLE 2

Shield Material Configurations

| Configuration | Source/Description |
|---|---|
| 1. Filled Composite (Space Micro) | Hi Z/Lo Z composite approach. Tungsten filled epoxy composite. 70% theoretical density. |
| 2. Blended Filled Composite (Space Micro) | Hi Z/Lo Z composite approach. Single or Multiple filler composite. >70% theoretical density. |

Modeling Performance Comparisons

Figure 2:
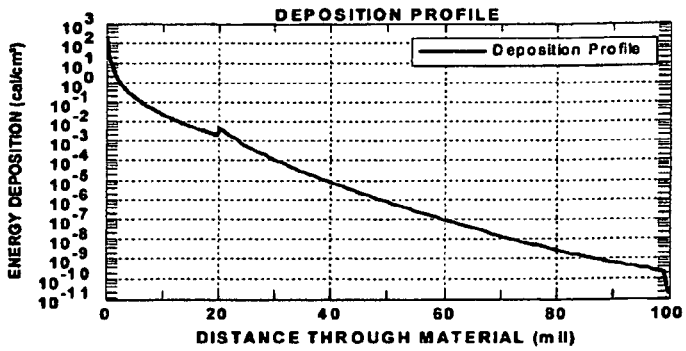
FIG. 2 is a graph of energy deposition vs. material depth to illustrate radiation attenuation provided by a first embodiment.

Configurations 1 and 2 are modeled for comparison, with the following configuration constructions: Configuration 1: 100 mils Tungsten/Organic Resin Composite, Configuration 2: A blend of 80 percent Tungsten and 20 percent Gadolinium/Organic Resin Composite. Modeling performance for X-ray shielding attenuation is seen below. Using 3 keV blackbody X-ray, with a fluence of 0.1 cal/cm$^2$. Using nominal 100 mil (0.100") thickness for both composite structures, these models both show eleven orders of magnitude attenuation in Dose Deposition through the sample as seen in FIGS. 2-4.

The differences between configuration 1 and 2 in the Table are the use of single filler versus blended fillers. Where a single filler system might be effective at blocking one radiation species, such as X rays, blended fillers provide the advantage of shielding multiple radiation species, for example, in the case of configuration 2, both X rays and neutrons.

What is claimed is:

1. An article comprising three major components, an adhesive, a filler, and a modifier, the article comprising primarily filler by volume, with the adhesive and any modifier agents filling the space between the filler particles, wherein the filler comprises Tungsten, Boron, Titanium, Gadolinium, Lead, Hafnium, Polyethylene, Aluminum or Gold; wherein the adhesives comprise epoxy, Bismalemide, or Cyanate Ester; and wherein the modifier includes fumed silica or alumina powder, that maximizes packing density of the fillers to provide optimal radiation shielding attenuation through proper filler particle size distribution (PSD) selection.

2. An article, according to claim 1, filled with high Hydrogen content filler, using polyethylene spheres.

3. An article according to claim 1, filled with multiple fillers to provide protection from radioactive species, such as X-rays and neutrons, using Tungsten and Gadolinium or Tungsten and Aluminum, or any combination of materials mentioned in claim 1.

4. An article according to claim 1, that provides radiation protection as an integral structure within a spacecraft.

5. An article according to claim 1, having filler particles of a preselected size in correspondence with a density corresponding to the particle size and wherein the article is cured to a preselected degree in correspondence with a preselected degree of rigidity.

6. An article according to claim 1, that employs novel processing techniques to optimize the shield density, via compaction and densification, through the use of a fugitive solvent, vibration, particle size distribution or a combination of these techniques.

7. An article according to claim 6, that combines Tungsten, between 50% and 100% of filler and Gadolinium, between 0% and 50% of filler by weight in optimal ratios to maximize radiation attenuation and shielding for black body X-ray and neutron radiation.

8. An article according to claim 4, that incorporates fumed silica, not to exceed 3% by weight, as a rheological additive, to assist in the homogeneous distribution of fillers during cure.

9. An article according to claim 4, that incorporates embedded sensors, including MEMS sensors, dosimeters, or other electronic devices to monitor an environment, for measurement of temperature, pressure and radiation exposure of the spacecraft.

* * * * *